US005517950A

United States Patent [19]

Kendrick

[11] Patent Number: 5,517,950

[45] **Date of Patent: * May 21, 1996**

[54] SYSTEM FOR SLAG REMOVAL AND THE LIKE

[76] Inventor: William E. Kendrick, 212 E. 4th St., Archie, Mo. 64725

[ * ] Notice: The portion of the term of this patent subsequent to Aug. 9, 2011, has been disclaimed.

[21] Appl. No.: 220,263

[22] Filed: Mar. 30, 1994

Related U.S. Application Data

[63] Continuation of Ser. No. 67,712, May 26, 1993, Pat. No. 5,355,844.

[51] Int. Cl.[6] ..... F22B 37/52

[52] U.S. Cl. ..... 122/390; 122/382; 110/170; 110/171; 15/316.1; 15/318.1; 266/136

[58] Field of Search ..... 122/382, 384, 122/390, 379; 266/136, 269; 110/170, 171, 259; 15/316.1, 318.1

[56] References Cited

U.S. PATENT DOCUMENTS

| | | | |
|---|---|---|---|
| Re. 32,517 | 10/1987 | Nelson | 122/379 |
| 2,825,923 | 3/1958 | De Mart . | |
| 3,788,527 | 1/1974 | Matson . | |
| 4,204,296 | 5/1980 | Reilly . | |
| 4,301,747 | 11/1981 | Lockwood, Jr. et al. | 110/171 |
| 4,492,187 | 1/1985 | Hammond . | |
| 4,567,622 | 2/1986 | Ziels . | |
| 4,969,942 | 11/1990 | Schwenninger . | |
| 5,040,262 | 8/1991 | Albers et al. . | |
| 5,063,632 | 11/1991 | Clark et al. | 15/316.1 |

OTHER PUBLICATIONS

Winchester Slagbuster Boiler Gun packet (Feb. 1991).

*Primary Examiner*—Denise L. Gromada
*Attorney, Agent, or Firm*—Chase & Yakimo

[57] ABSTRACT

A cleaning system comprises a compressor for delivering pressurized air to an accumulator via a valve controlled line. An outlet line extends from the accumulator and terminates adjacent a furnace floor drain. Upon command the entire volume of pressurized air is instantaneously released from the accumulator for discharge out the outlet line and through the furnace drain. The relatively cooler, high pressurized air blasts impacts, vibrates and chills any slag deposits accumulating about the drain so as to remove the same. An alternative nozzle is disclosed which disperses the high impact blast about the drain.

2 Claims, 2 Drawing Sheets

SYSTEM FOR SLAG REMOVAL AND THE LIKE

This application is a continuation of application Ser. No. 08/067,712, filed May 26, 1993 now U.S. Pat. No. 5,355, 844.

BACKGROUND OF THE INVENTION

This invention relates to a cleaning system for precluding the formation of obstructions about the drain of boilers or the like.

Various devices have been employed to clean the surfaces of furnaces, boilers and other heat exchange devices. Soot-blowing systems of the so-called "puff type" are utilized. These devices discharge steam in a succession of relatively short blasts against the surfaces to be cleaned. These devices present a "lance"/shaft having a nozzle at one end which is inserted into the boiler. The nozzle injects a cleansing fluid, such as steam, which is directed onto the surface, e.g. boiler walls, in an attempt to blow away accumulated soot and ash. Due to the high internal operating temperature of the boiler, the nozzle end of the lances are inserted into the boiler for a short period of time only so as to protect their operating mechanisms. Hundreds of such lances are required for use with huge power plant boilers.

In certain boilers such as those used in coal fired power plants, ash elimination is accomplished either by a carryover (dry particulate) method or by a bottom drain method depending on the state of the by-products of burning. In the latter method it is essential that the ash remain molten, i.e. slag. Otherwise, it will adhere to all metal surfaces. However, this molten slag tends to solidify at the furnace floor drain above the slag tank. This solidification will cause the subsequent slag deposits to flow over the previously solidified slag. If the slag deposits are not removed the deposits will eventually form layers and obstruct the furnace drain commonly referred to as the "monkey" hole. The formation of such obstructions results in a decrease in operating efficiency. In some cases it is necessary to shut the furnace down and remove the solidified slag deposits by air hammers and/or dynamite.

The above-described prior art soot blowers are not sufficient to preclude such obstructions of the "monkey" hole. Such prior art soot blowers rely on steam as a cleaning agent and are designed to operate in a "puff" like manner, i.e. a continuous flow of steam at a constant pressure is directed at the surface to be cleaned. Such fluid flow is designed to remove dry particulate ash from the interior boiler surfaces. However, these blowers are not designed for removal of the heavy molten slag forming at the "monkey" hole of the boiler.

In response thereto a cleansing system is presented which utilizes a blast of compressed high pressure air for removal of the accumulated molten slag. Compressed air is routed to an accumulator at high pressure for increasing the air volume. Extending from this accumulator is an air conduit having an open nozzle at the distal end thereof. The distal end terminates at the monkey hole from the underside of the surrounding drain floor. A control unit allows the large volume of pressurized air residing in the accumulator to be selectably or periodically directed at the monkey hole. This blast of air impacts the molten slag passing through the hole and/or accumulating therearound. The instantaneous impact of the large volume of relatively cold, high pressurized air chills and vibrates the molten slag. This action forms a plurality of particulate materials which fall into the slag tank therebelow. Various nozzle designs employing a primary blast of air through the monkey hole and optional, smaller concurrent air blasts for direction about the monkey hole can be utilized. The system precludes the formation of slag deposits in the monkey hole and subsequent obstruction thereof. Such system is adaptable for use in precluding the formation of deposits on other structures.

It is therefore an important object of this invention to provide a device for elimination of molten slag/pluggage from boiler and/or furnace component surfaces, e.g. the drain/"monkey" hole of a furnace or the like.

Another object of this invention is to provide a device, as aforesaid, which impacts and chills the molten slag in a manner to change the same into smaller particulates for subsequent removal.

Another important object of the invention is to provide a device, as aforesaid, which utilizes an instantaneous blast of a large volume of high pressurized air as the cleaning agent.

A further object of this invention is to provide a device, as aforesaid, which uses blasting acoustics to preclude slag formation about the monkey hole.

Another object of this invention is to provide a device, as aforesaid, which is suitable for use below the drain floor of the furnace proper.

A more particular object of this invention is to provide a device, as aforesaid, which either directs the entire volume of high pressure air through the monkey hole center and/or disperses the air in a succession of smaller blasts therearound.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
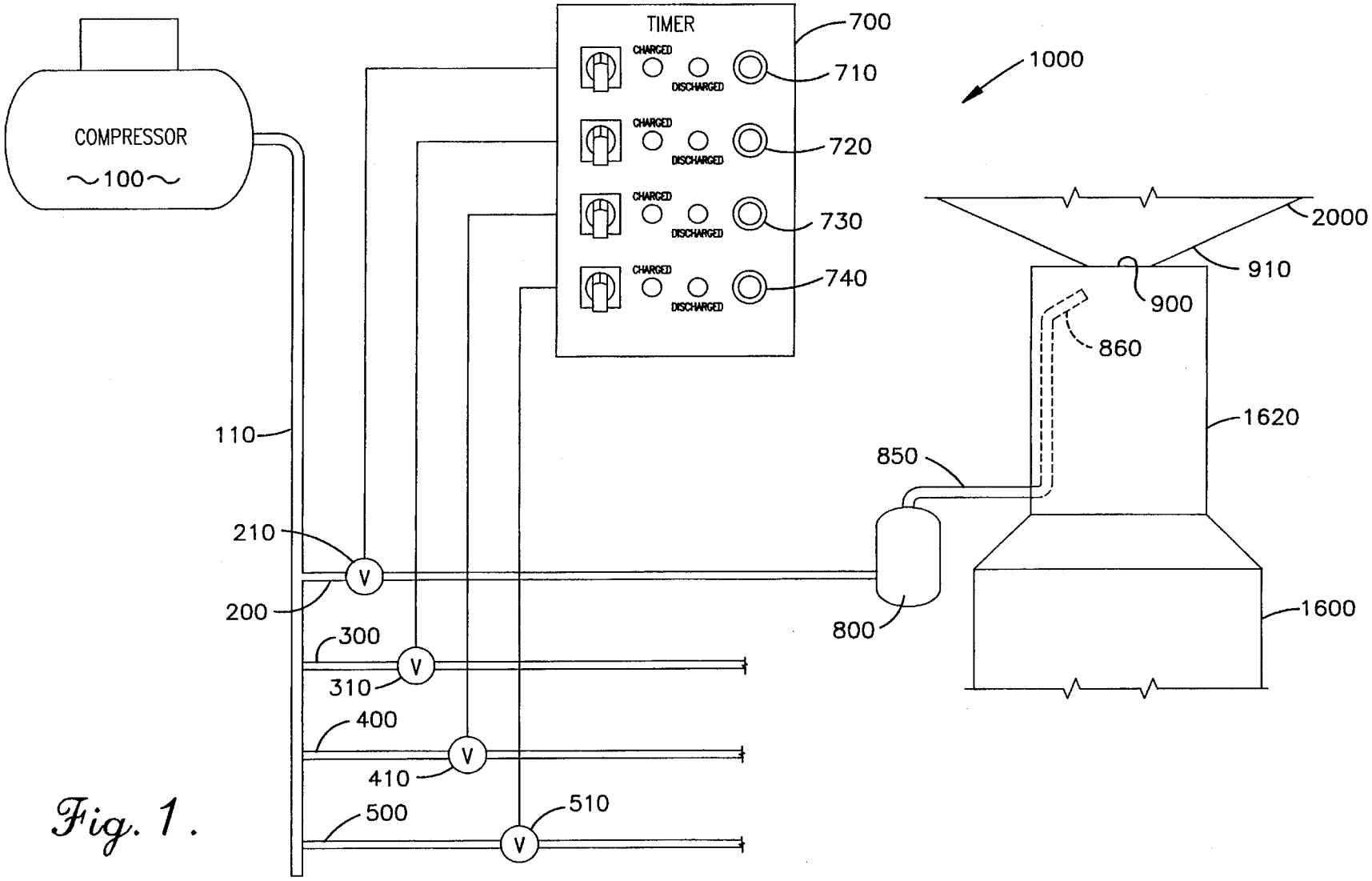
FIG. 1 is a diagrammatic view of the cleaning system as integrated for use in a four boiler plant environment.

Turning more particularly to the drawings, FIG. 1 diagrammatically shows the drain cleaning system 1000 for a furnace and/or boiler 2000 with only one of the four boilers 2000 being fragmentarily shown to assist in illustration. The slag pit 1600 is shown therebelow with intermediate connecting tank 1620.

As shown the system 1000 comprises an air compressor 100 having a pressurized air delivery line 110 extending therefrom. Connected to the delivery line 110, via a manifold (not shown) or the like, are air input lines 200, 300, 400, 500. Each input line has a controlled solenoid valve 210, 310, 410, 510 interposed therein for regulating the passage of the pressurized air therethrough. Each valve is controlled by conventional electronic circuitry, the controls being presented to the user by a timer control unit 700. Air is preferably delivered from the compressor 100 at approximately 100–140 p.s.i. through the valve for storage in the accumulator 800.

The accumulator 800 comprises an internal air reservoir and piston assembly therein. Movement of the internal piston assembly discharges the compressed air stored in the reservoir upon cessation of the delivery of pressurized air to accumulator 800. I utilize an air tank accumulator referred to as a "Big Blaster"® provided by the Martin Engineering Company. This accumulator is disclosed in U.S. Pat. No. 3,788,527. As discussed therein, air under pressure enters the accumulator and bears against the piston which seals an air port of the tank. The pressurized air from the input line 200 accumulates in the reservoir of the tank (approximately 11 cubic feet). Upon the air pressure in the tank equalizing the line 200 pressure the air flow is static and accumulator 800 is ready for discharge. Upon activating the solenoid valve 210 the compressed air in line 200 is released and no longer bears against the piston. The pressurized air in the accumulator 800 moves the piston to its discharge position. This position allows for an instantaneous release of the entire volume of the previously accumulated 800 air into the discharge duct 850. Thus, a large volume of cool air, relative to the slag 1200 temperature, is released as a blast out the distal end 860/nozzle of discharge duct 850.

The timer 700 includes conventional circuitry which periodically opens the respective solenoid valve 210, 310, 410, 510. Thus, the frequency of accumulator discharges or blasts can be controlled. Alternatively, each valve can be manually activated by depression of the appropriate release button 710, 720, 730, 740 on the timer 700 by the user.

Figure 3:
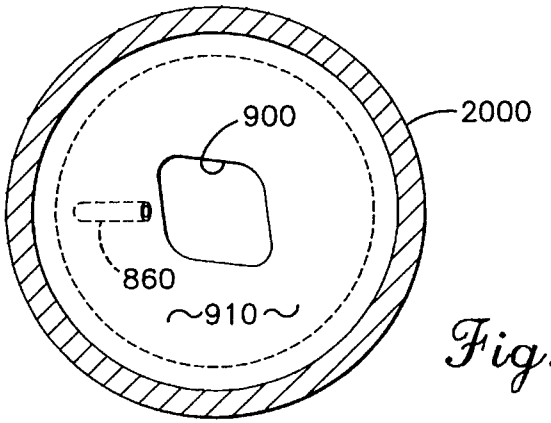
FIG. 3 is a view from within the furnace looking down at the floor drain or "monkey hole" with the first air nozzle embodiment of the device shown in phantom below the drain floor.

The accumulator 800 air is discharged through the outlet duct 850 and directed to the discharge end 860/nozzle at the free end thereof. As diagrammatically shown this nozzle is directed towards the center of the floor 910 drain/"monkey hole" 900 of the furnace. The air blast nozzle 860 in the form of an open pipe (1½"), as best seen in FIG. 3, directs the blast of air through the center of the "monkey hole" 900 so as to impact, vibrate and chill any slag 1200 which may be accumulating and tending to solidify around the hole 900. As the outside air blast is at a much lower temperature than the temperature of the slag 1200, a "chilling" of the slag 1200 occurs. This chilling and vibration causes the slag 1200 to break up into pieces and fall into the water 1600 filled slag tank 1610 therebelow. Accordingly, it is important that the air stream be a "blast" type of stream of approximately 100–140 p.s.i. as opposed to a continuous low pressure stream. As best shown in FIG. 3 the discharge end of nozzle 860 lies below the floor 910 of the "monkey hole" 900 to preclude the slag 1200 from being deposited thereon and rendering the nozzle 860 inoperative.

Figure 4:
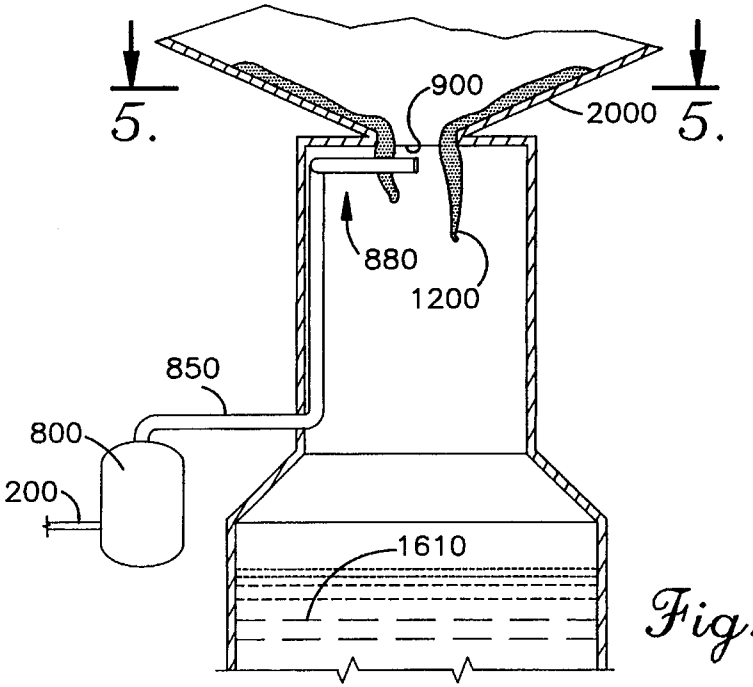
FIG. 4 is a diagrammatic view of the air blast delivery portion of the system utilizing an alternative nozzle embodiment therein.
Figure 5:
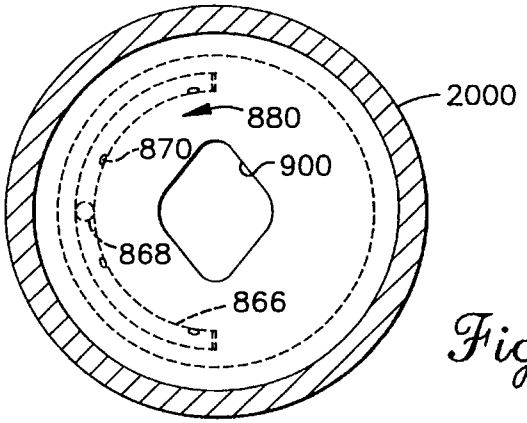
FIG. 5 is a view from within the furnace looking down at the floor drain or "monkey hole" in the furnace floor with the alternative blast nozzle of FIG. 4 being shown in phantom below the drain floor.
Figure 2:
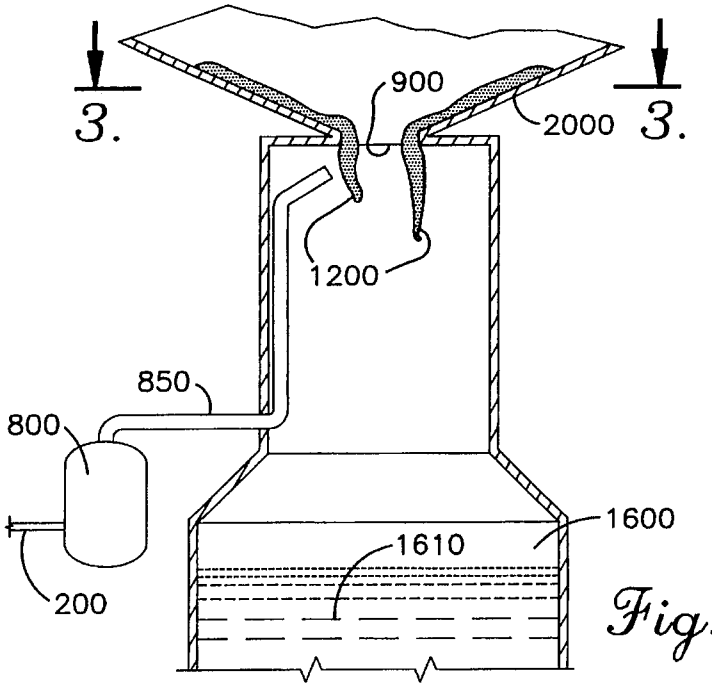
FIG. 2 is a diagrammatic view of the air blast delivery portion of the system, as positioned below the drain floor of the furnace with the slag pit therebelow, the system utilizing a first nozzle embodiment therein.

An alternative nozzle assembly 880 is as shown in FIGS. 4 and 5. Nozzle 880 includes a generally semi-circular ring 866 having a first exhaust port 868 directed towards the hole 900 center and a series of smaller discharge apertures 870 therein. Ring 866 is connected to the discharge line 850 at the free end 860 thereof. Port 868 is smaller than the cross-sectional area of the discharge line 850. This relationship precludes the compressed air in the discharge line 850 from being discharged entirely through this port 868. Thus, the remaining air is directed about the ring 866 and through the apertures 870. Accordingly, a first blast of high pressure air is directed through the center of the monkey hole 900 as in FIG. 2 with the remaining air being dispersed through apertures 870 and about the monkey hole 900 so as to preclude the formation of slag deposits about the hole 900 perimeter.

It is to be understood that while certain forms of this invention have been illustrated and described, it is not limited thereto except insofar as such limitations are included in the following claims and allowable functional equivalents thereof.

Having thus described the invention what is claimed as new and desired to be secured by Letters Patent is as follows:

1. A system for precluding the formation of deposits about components of a furnace comprising:

a compressor;

an accumulator for storage of high pressurized air therein, said accumulator having means therein for quickly discharging the accumulated air from an outlet;

a first air line communicating said compressor to said accumulator;

valve means interposed in said air line for regulating the passage of compressed air from said compressor;

an outlet line extending from said accumulator outlet and having a free end terminating adjacent a selected component of the furnace;

control means for positioning said valve means in a first mode to allow flow of said compressed air through said valve and into said accumulator and a second mode for ceasing the compressed air flow into the accumulator;

said accumulator instantly discharging the compressed air from said outlet upon positioning of said valve means to said second mode, said discharged air directed out said free end of said outlet line and onto the selected furnace component, the discharged air vibrating and chilling any deposits on the furnace component to preclude formation thereon.

2. For use with a furnace, an air blast system for a cleansing action upon a furnace component comprising:

a compressor;

an accumulator for the storage of compressed air therein, said accumulator having means for instantaneous discharge of the stored air therefrom;

an air line communicating said compressor and said accumulator;

a valve having a first position for entry of compressed air from said compressor into said accumulator and a second position for ceasing delivery of the compressed air to said accumulator;

an air duct extending from said accumulator and having a free end adjacent the furnace component:

control means for regulating said valve between said first and second positions;

a nozzle at the free end of said air duct for directing the discharged air from said accumulator onto the furnace component, said discharged air providing the cleansing action.

* * * * *